US005909709A

United States Patent [19]

An et al.

[11] Patent Number: 5,909,709

[45] Date of Patent: Jun. 8, 1999

[54] STACKABLE STAMPS

[75] Inventors: Suk Ku An, Gyunggido, Rep. of Korea; Norman D. Siegfried, Crystal Lake, Ill.; Brian L. Adkinson, Stettin, Wis.

[73] Assignee: Fiskars Inc., Madison, Wis.

[21] Appl. No.: 08/911,333

[22] Filed: Aug. 14, 1997

[51] Int. Cl.[6] ..... B41K 1/56

[52] U.S. Cl. ..... 101/405; 101/109; 101/333

[58] Field of Search ..... 101/103, 333, 101/327, 405, 406, 93, 109

[56] References Cited

U.S. PATENT DOCUMENTS

| | | | |
|---|---|---|---|
| 1,334,540 | 3/1920 | Jones | 101/333 |
| 2,584,908 | 2/1952 | Oblinger | 101/333 |
| 2,891,472 | 6/1959 | Holzer | 101/333 |
| 3,020,838 | 2/1962 | Prost | 101/333 |
| 3,090,304 | 5/1963 | Sulkie | 101/333 |
| 4,392,425 | 7/1983 | Capezzuto et al. | 101/327 |
| 4,854,235 | 8/1989 | Lyon | 101/405 |
| 5,191,837 | 3/1993 | Bolton | 101/333 |
| 5,313,885 | 5/1994 | Winston | 101/405 |
| 5,579,692 | 12/1996 | Collier | 101/405 |

OTHER PUBLICATIONS

Clear Snap—Stamp Products Resource Book 1994–1995 Anacortes, WA 98221.

*Primary Examiner*—John Hilten
*Assistant Examiner*—Leslie Grohusky
*Attorney, Agent, or Firm*—Foley & Lardner

[57] ABSTRACT

A stackable stamp assembly used to form images on a surface includes a substantially congruent and releasably engageable base, intermediate members, and cover assembly. A stamp is attached to each of the intermediate members. The intermediate members are dish-shaped so that the stamp of an upper member is received within the member disposed immediately below when the members are stacked one on top of the other. The assembly may also includes ways to facilitate the alignment of the assembly with the surface on which an imprint of the stamp is to be made.

4 Claims, 2 Drawing Sheets

FIG. 5
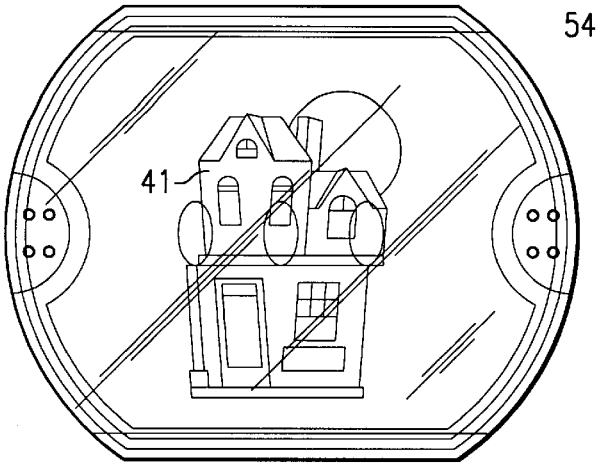
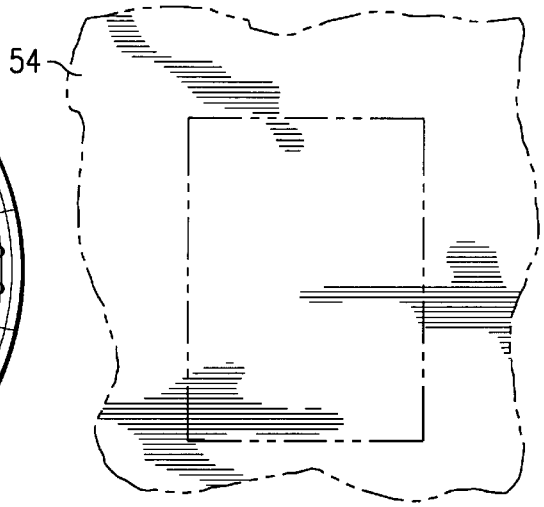
FIG. 6
FIG. 7
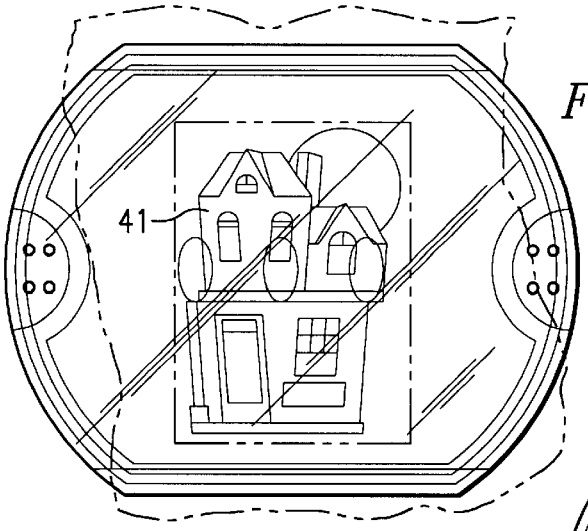
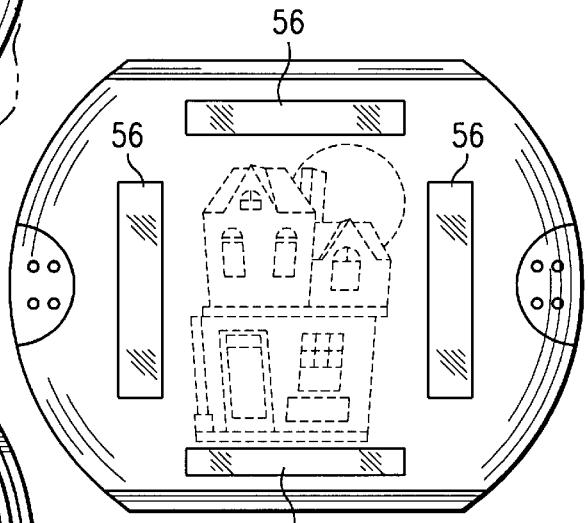
FIG. 8
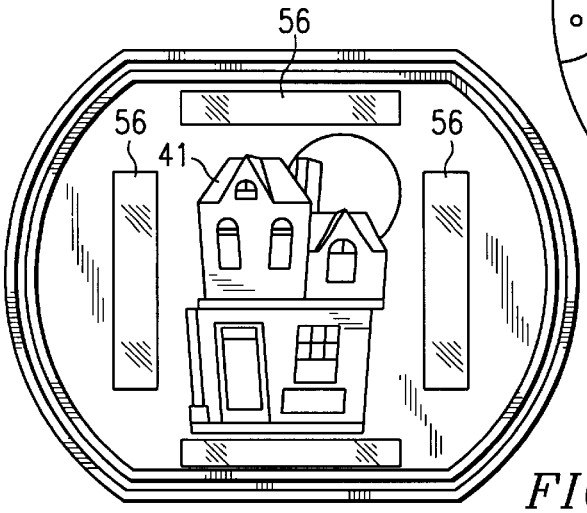
FIG. 9

STACKABLE STAMPS

FIELD OF THE INVENTION

The present invention relates generally to the art of stamping devices. More particularly, the present invention relates to a stamp assembly which includes a stacking feature to provide upright stackable storage and handling of multiple stamps and related stamping paraphernalia. The assembly also includes an alignment feature to align the stamp assembly relative to a stamp impression receiving surface.

BACKGROUND OF THE INVENTION

In recent years, stamping has become increasingly sophisticated due to the intricacy of the available stamp impressions, the use of multiple stamps (i.e. overlapping several stamp impressions) and of various types of inks. In general, stamping devices consist of a rubber stamp attached to an opaque handle and/or mounting plate, and of a separate inking pad for applying ink to the stamp. Frequently, an office or home will have several of these stamping devices as well as one or more inking pads. These prior art configurations typically occupy significant space on a desk, and are prone to being misplaced due to the small size of their components. Also, when multiple stamp impressions are made, it is often difficult to accurately position the stamping device relative to the surface on which the impressions are to be made.

Some of these shortcomings have been recognized by those skilled in the art specifically, U.S. Pat. No. 3,090,304 issued on May 21, 1963 to Sulkie discloses a stamp assembly having a plurality of nested cup-shaped elements (each having tapered sides), and a base support. Each cup-shaped element also includes a mounted inking pad on the inside bottom of the cup and an interchangeably mountable rubber stamp on the outside bottom of the cup. When the cup-shaped elements are nested one on top of the other, each rubber stamp is in contact with the inking pad of the cup below. Similarly, U.S. Pat. No. 2,891,472 issued on Jun. 23, 1959 to Holzer also covers a nested stamp assembly. As can be readily appreciated, however, the nested cup-shaped configuration of Sulkie and Holzer typically increases the height of the assembly, thereby requiring a base support to increase its stability. In addition, such configurations do not include features to facilitate the alignment of the stamp with the receiving surface.

Thus, it is desirable to provide a stamp assembly which can alleviate the problems associated with prior art devices by providing more efficient storage and handling of the assembly components, and by facilitating the use of these devices, without undesirably increasing their cost.

SUMMARY OF THE INVENTION

The stamp assembly in accordance with the present invention is designed to limit overall dimensions of a multi-stamp unit, and to make its use more convenient by facilitating the alignment of the stamp assembly relative to the surface on which a stamp impression is to be made.

In accordance with one aspect of the invention, the device is configured as a stamp assembly having a base, a plurality of intermediate members, and a cover, all tackably engaged to one other. The base may include an inking pad, and the cover is configured to substantially conform to a user's palm. A stamp is attached to the bottom of a respective intermediate members, and an image representative of the stamp is affixed to the top surface of that member.

In accordance with a further aspect of the invention, the base, each intermediate member, and the cover are substantially congruent. The assembly may also include an interference fit between the base, the intermediate members, and the cover.

In accordance to another aspect of the invention, the assembly includes means for aligning it relative to a stamp impression receiving surface, the aligning means including at least one aperture formed through the top and bottom of the intermediate member. Alternatively, transparent material may be used to form the cover, the intermediate members, and the base.

Other advantages of the present invention will become apparent from the detailed description given hereinafter. It should be understood, however, that the detailed description and specific embodiments are given by way of illustration only since, from this detailed description, various changes and modifications within the spirit and scope of the invention will become apparent to those skilled in the art.

BRIEF DESCRIPTION OF THE DRAWINGS

The preferred embodiment of the present invention will hereinafter be described in conjunction with the appended drawings, wherein like numerals denote like elements and:

FIG. 5 is a top view of the Stamp Assembly of the present invention, the Assembly being made of a substantially transparent material;

FIG. 6 is a top view of the stamp impression receiving surface showing a desired stamp impression location;

FIG. 7 is a top view of the Stamp Assembly shown in alignment with the desired stamp impression location shown in FIG. 6;

FIG. 8 is a top view of the Stamp Assembly of the present invention shown with alignment apertures; and FIG. 9 is a top view of one intermediate member shown with an image attached thereto and alignment apertures.

DETAILED DESCRIPTION OF A PREFERRED EXEMPLARY EMBODIMENT

Figure 1:
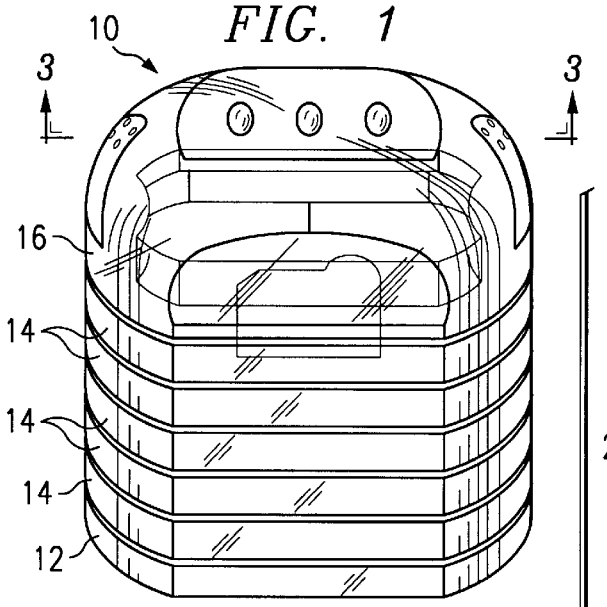
FIG. 1 is a perspective view of the Stamp Assembly of the present invention, the Assembly being shown in the stacked configuration.

The present invention relates to hand-held stamping assemblies comprising a plurality of stamps that can be stacked to reduce the overall dimensions of the assembly. More particularly, the present invention relates to stamp assemblies typically used in arts and crafts, which include a stacking feature to provide upright stackable storage and handling of multiple stamps and related stamping paraphernalia. It will become apparent from the following description, however, that the stamp assembly of the present invention may include fewer or more stamps, and that it may have a configuration other than the one described herein, for application to uses other than those discussed below.

However, for ease of understanding and convenience the following description will simply refer to the stamp assembly illustrated in the drawings. Nevertheless, those skilled in the art will readily recognize its many other configurations and applications.

Referring to the Figures, a stamp assembly in accordance with the present invention, designated generally as 10, includes a base 12, at least one intermediate member 14, and a cover 16. As illustrated in the Figures, when base 12, intermediate members 14, and cover 16 are stacked together, they form a substantially congruent assembly 10, i.e., they are in substantial alignment when assembled. Also, cover 16 is generally convex, configured to conveniently conform to the user's palm.

Base 12 is preferably dish-shaped, including a bottom 18 and upstanding cincturing side walls 20 that extend to a top edge 22. Bottom 18 of base 12 is substantially flat to support stamp assembly 10 in an upright position. Assembly 10 also preferably includes a plurality of dish-shaped intermediate member 14, each being formed by a bottom surface 24, and upstanding cincturing side walls 26 extending to a top edge 28. A lowermost of the intermediate members 14 releasably engages base 12. Assembly 10 also includes a cover 16 having a top 30 and an oppositely facing bottom 32. Bottom 32 has a bottom edge 34 substantially cincturing cover 16, bottom edge 34 been releasably engageable with top edge 28 of an uppermost intermediate member 14.

Assembly 10 also includes a plurality of stamps 36, each stamp 36 advantageously having a foam backing 38 attached to bottom surface 24 of intermediate member 14. As shown in the Figures, the height of side walls 20 of base 12 is greater than the thickness the stamp-backing combination 40. As a result, when intermediate member 14 engages base 12 combination 40 is fully received within base 12. Similarly, the height of side walls 26 of intermediate members 14 is greater than the thickness stamp-backing combination 40. As a result, when an upper intermediate member 14 engages a lower intermediate member, combination 40 is fully received within the lower intermediate member 14. Each intermediate member 14 also preferably includes an image 41 representative of individual stamp 36, and affixed to intermediate member 14 to permit the user to readily identify the desired intermediate member 14. Finally, assembly 10 may also include an inking pad 42 or other inking device disposed within base 12 so that no separate device is required to use stamp 10.

Figure 2:
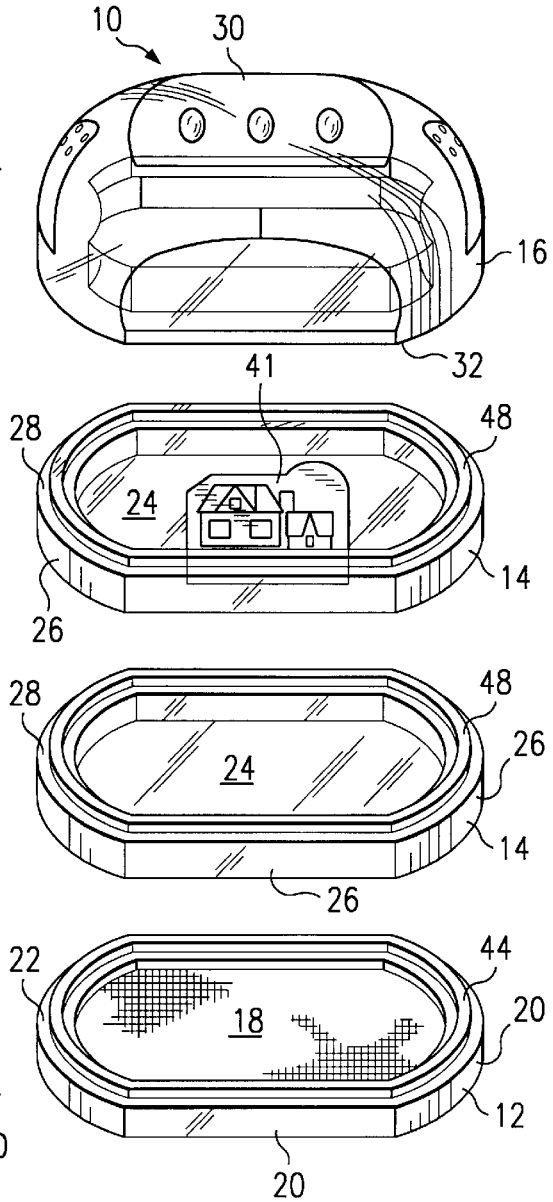
FIG. 2 is an exploded view of the Stamp Assembly shown in FIG. 1.
Figure 3:
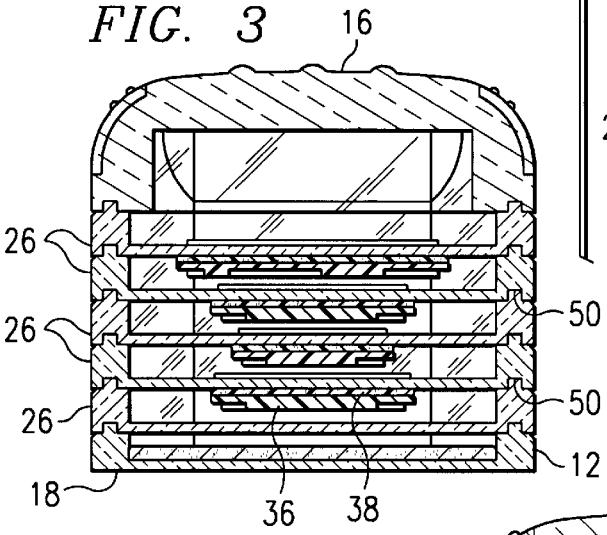
FIG. 3 is a cross-sectional view taken along line 3—3 shown in FIG. 1.
Figure 4:
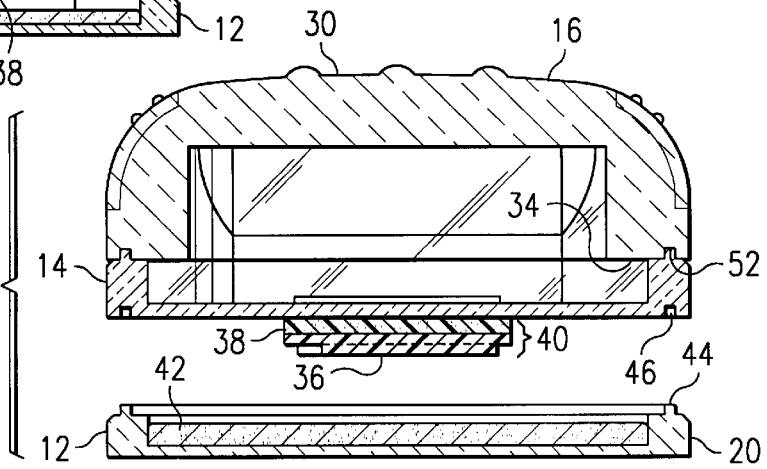
FIG. 4 is a cross-sectional view of the cover, of one intermediate member to which a stamp is affixed, the stamp being shown proximate to the base.

Base 12, intermediate members 14, and cover 16 of assembly 10 are respectively releasably connected by means of a friction fit engagement. Such friction fit may be provided by a tongue and groove configuration as more particularly shown in FIGS. 2–4. In particular, top edge 22 of base 12 includes a tongue 44 cooperating with a groove 46 formed in the lowermost intermediate member 14. Similarly, top edge 28 of intermediate member 14 includes a tongue 48 cooperating with a groove 50 formed in the intermediate member 14 disposed immediately above. Similarly tongue 48 of the uppermost intermediate member 14 releasably engages a groove 52 formed along bottom edge 34 of cover 16. Those skilled in the art will, however, readily appreciate that the friction fit between the cover, the intermediate members and the base may be provided in other ways. For example, the tongue and groove arrangements could be reversed in certain cases, e.g., the tongues being at the bottom of intermediate members 14 and cover, while the groove would be formed at the top of the intermediate members and of the base. In addition, the tongues and groove do not have to be formed along the perimeter of the base, cover, and intermediate members, depending on the extent of the respective releasable engagement desired.

Referring now more particularly to FIGS. 5–9, assembly 10 may also include means to facilitate the alignment of stamp assembly 10 and thereby stamp 36 relative to a surface 54 on which an impression of stamp 36 is to be made. This aligning function can be performed by a plurality of apertures generally designated as 56 formed in cover 16, intermediate members 14, and base 12. Apertures 56 are in sufficient alignment to permit the user to see surface 54 through assembly 10. Alternatively, a substantially transparent, translucent, or otherwise clear material may be used to form cover 16, intermediate members 14, and base 12.

It is understood that the above description is of a preferred exemplary embodiment of the present invention, and that the invention is not limited to the specific forms described. For example, assembly 10 could take other forms and include a single intermediate member 14 or, conversely, more than the number shown. In addition and as explained above, the friction fit assembly can be performed in ways other than those described. Finally, it should be recognized that depending on how stamps 36 are constructed, they could be attached directly to intermediate members 14, i.e., without using foam backing 38. It should therefore be understood that these and other substitutions, modifications, changes and omissions may be made in the design and arrangement of the elements disclosed herein without departing from the scope of the appended claims.

We claim:

1. A stackable stamp assembly used to form images on a surface, the assembly being substantially congruent and comprising:

a plurality of intermediate members, each intermediate member having a top edge and an oppositely facing bottom edge;

a cover having a top oppositely facing a bottom having a bottom edge, an uppermost member of the plurality of intermediate members disposed closest to the cover and releasable engaging the cover;

each intermediate member of the plurality of intermediate members having a stamp attached to its bottom; and substantially aligned apertures formed through the cover and the intermediate members for aligning the stamp assembly relative to the surface.

2. The stamp assembly of claim 1 further comprising:

a base;

a lowermost member of the plurality of intermediate members being closest to the base and releasably engaging the base; and substantially aligned apertures formed through the lowermost member and the base for aligning the stamp assembly relative to the surface.

3. A stackable stamp assembly used to form images on a surface, the assembly being substantially congruent and comprising:

a plurality of transparent intermediate members, each intermediate member having a top edge and an oppositely facing bottom edge;

a transparent cover having a top oppositely facing a bottom having a bottom edge, an uppermost member of the plurality of intermediate members disposed closest to the cover and releasably engaging the cover; and each intermediate member of the plurality of intermediate members having a stamp attached to its bottom, wherein the transparent cover and the transparent intermediate members permit a user to view the surface through the cover and intermediate members so as to align the stamp assembly to the surface.

4. The stamp assembly of claim 3 further comprising:

a transparent base permitting a user to view the surface through the base so as to align the stamp assembly to the surface; and a lowermost member of the plurality of transparent intermediate members being closest to the base and releasably engaging the base.

* * * * *